US007300509B2

(12) United States Patent
Hiscock et al.

(10) Patent No.: US 7,300,509 B2
(45) Date of Patent: Nov. 27, 2007

(54) AQUEOUS PIGMENTED COATING FORMULATION PROVIDING FOR IMPROVED OPACITY

(75) Inventors: Donald Hiscock, St. Louis, MO (US); Joseph N. Casey, Glen Carbon, IL (US); Jonathan Maynes, St. Peters, MO (US)

(73) Assignee: Solae LLC, St. Louis, MO (US)

( * ) Notice: Subject to any disclaimer, the term of this patent is extended or adjusted under 35 U.S.C. 154(b) by 97 days.

(21) Appl. No.: 11/080,886

(22) Filed: Mar. 15, 2005

(65) Prior Publication Data

US 2006/0207737 A1 Sep. 21, 2006

(51) Int. Cl.
*C09D 7/12* (2006.01)

(52) U.S. Cl. ..... 106/287.35; 162/158

(58) Field of Classification Search ..... 106/287.35; 162/158

See application file for complete search history.

(56) References Cited

U.S. PATENT DOCUMENTS 5,858,933 A * 1/1999 Nikoloff ..... 508/428

OTHER PUBLICATIONS

Rohmann, "Paper and Pulp, 9. Coating of Paper and Board" Ullmann's Encyclopedia of Industrial Chemistry, article posted online Jun. 15, 2000.*

* cited by examiner

*Primary Examiner*—David M Brunsman
(74) *Attorney, Agent, or Firm*—James L. Cordek; Holly M. Amjad

(57) ABSTRACT

Aqueous pigmented coating formulations for improving opacity and processes for their manufacture are disclosed. Specifically, the aqueous pigmented coating formulations comprise an acylated lecithin that comprises a chemically modified lecithin and less than 10% (by total weight acylated lecithin) free fatty acid. Additionally, the acylated lecithin is substantially free of fatty acid esters and surfactants. The acylated lecithin provides an increase in opacity to paper and paperboard coated with the aqueous pigmented coating formulation.

17 Claims, 1 Drawing Sheet

◆ BASE COATING FORMULA (CONTROL 2), LINEAR ——
■ BCF + CENTROPHASE HR (CHR) (SAMPLE A), LINEAR - - -
▲ BCF + CHR + PVA-LATEX – CMC (SAMPLE B), LINEAR – –
× BCF + CHR + PROTEIN – CMC (SAMPLE C), LINEAR ——

AQUEOUS PIGMENTED COATING FORMULATION PROVIDING FOR IMPROVED OPACITY

BACKGROUND OF THE INVENTION

The present invention generally relates to aqueous pigmented coating formulations for improving opacity in paper, paperboard, and related products and methods for making such aqueous pigmented coating formulations. More particularly, the present invention relates to aqueous pigmented coating formulations comprising an acylated lecithin for use in coating paper and paperboard. The acylated lecithin increases the opacity of paper and/or paperboard coated with the aqueous pigmented coating formulation.

Aqueous pigmented coating formulations are generally used in processes for making paper and paperboard. The unique functional and optical properties of paper are derived through the paper making process and the coating formulations used therein. Conventional coating formulations are dispersions of mineral pigments, binders, and additives in water. Pigment-containing coating formulations provide paper with a desirable finish, gloss, and smoothness. For example, one major function of coating formulations, such as the aqueous pigmented coating formulations, is to improve the appearance of the paper or paperboard by increasing properties such as opacity, brightness, and surface smoothness and gloss. Typically, the pigment in the coating fills in irregularities in the paper surface, producing an even and uniformly absorbent surface for printing and improving the overall appearance of the coated sheet.

The binder or adhesive present in the formulation influences the properties of the coating formulation and the properties of the final coated paper. For example, the binder functions: (1) to impart the required rheology behavior and water retention to the coating formulation; (2) to bind the pigment particles together in the dried coating and to the paper web; and (3) to control the absorption of printing ink during printing on the paper.

The opacity of paper is that property of paper which minimizes the show-through of light through the sheet or printing from the back side or the next sheet. The opacity of a surface coating on paper and paperboard is particularly important where the base fiber is dark or non-uniform. Opacity may be affected by thickness, filler, and calendering of the coating formulations used in the papermaking process. Specifically, opacity is derived through a combination of light scattering and light absorption within the coating layer of coated paper or coated paperboard. Generally, a high level of opacity in the coating layer and in the finished paper or paperboard structure is desirable to improve the quality of the finished product.

There have been several attempts at increasing the opacity-providing characteristics of aqueous pigmented coating formulations for use in the papermaking process. For example, high refractive index pigments such as titanium dioxide are well-known to increase opacity, but these materials are costly and affect other properties, such as color and shade, which may not be desirable for some paper grades. Additionally, titanium dioxide has high ultraviolet absorbance, which negatively impacts the optical brightening efficiency of fluorescent dyes added to the coating as florescent whitening agents.

Other approaches to increasing opacity focus on improving the light scattering. This includes approaches, such as utilizing the mechanism of increased void volume and the consequent increase in the number of air-pigment interfaces, to promote additional scattering, or using structured pigments, such as anhydrous calcined clays. These structured pigments are more expensive than conventional pigments. Additionally, they usually increase the abrasivity of the coating formulation, leading to faster wear on the production equipment, with consequent costs for downtime and maintenance of replaceable wear elements like coater blades. Structured pigments can also impact the print quality of paper, as the higher capillary volume of the void-filled pigment can lead to rapid ink setting and resulting defects due to ink mottle or non-uniform ink distribution in the printed area.

Light scattering, and its impact on opacity, has also been utilized to increase opacity through the use of cationically-charged polymers which flocculate the anionic pigment slurry to give random pigment packing and consequent higher light scattering. These materials are generally difficult to control in practice since the operational efficiency of the coating is often compromised by the addition of flocculants, and small dosage variations can result in major issues with stability. As such, destabilization of the colloidal pigment suspension is not a desirable route to higher scattering.

Light absorption, such as that obtained by adding black dye to the coating formulation, is another well-known route to obtaining higher opacity in the finished product. Through the proper selection of dye colors, which can include, for example, blue, black, and red, the final shade of the coating may be maintained, although the use of dyes that absorb in the visible region may reduce the brightness or overall reflectance of the coating. This usually results in an unacceptable compromise in the final sheet quality of the coated paper.

As such, a need exists in the industry for an aqueous pigmented coating formulation that provides an increase in the opacity of paper and/or paperboard coated with the aqueous pigmented coating formulation. Additionally, it is desirable that the increased opacity is obtained without compromising the other physical or optical properties of the paper or paperboard and by avoiding the use of expensive additives such as high refractive index pigments.

SUMMARY OF THE INVENTION

In one embodiment, the present invention provides aqueous pigmented coating formulations for improving opacity of paper and/or paperboard. Specifically, these formulations include an acylated lecithin that provides increased opacity to paper and/or paperboard coated with the formulations. The acylated lecithin is substantially free of fatty acid esters and surfactants. The present invention also provides methods for preparing the aqueous pigmented coating formulations including the acylated lecithin, as well as paper products coated with the pigmented coating formulation.

As such, the present invention is directed to an aqueous pigmented coating formulation for improving opacity. The aqueous pigmented coating formulation comprises pigment, from about 3.0 parts (per hundred parts pigment) to about 30 parts (per hundred parts pigment) binder, and from about 0.1 parts (per hundred parts pigment) to about 5.0 parts (per hundred parts pigment) acylated lecithin, wherein the acylated lecithin is substantially free of fatty acid esters and surfactants.

The present invention is further directed to a process for producing an aqueous pigmented coating formulation for improving opacity. The process comprises providing pigment; providing from about 3.0 parts (per hundred parts pigment) to about 30 parts (per hundred parts pigment)

binder; providing from about 0.1 parts (per hundred parts pigment) to about 5.0 parts (per hundred parts pigment) acylated lecithin; and mixing the pigment, binder and acylated lecithin to form the aqueous pigmented coating formulation. The acylated lecithin is substantially free of fatty acid esters and surfactants.

The present invention is further directed to a coated paper product produced utilizing an aqueous pigmented coating formulation comprising an acylated lecithin. The coated paper has an improved opacity of about 3% as compared to an uncoated paper product.

Other features and advantages of this invention will be in part apparent and in part pointed out hereinafter.

DETAILED DESCRIPTION OF THE PREFERRED EMBODIMENTS

Figure 1:
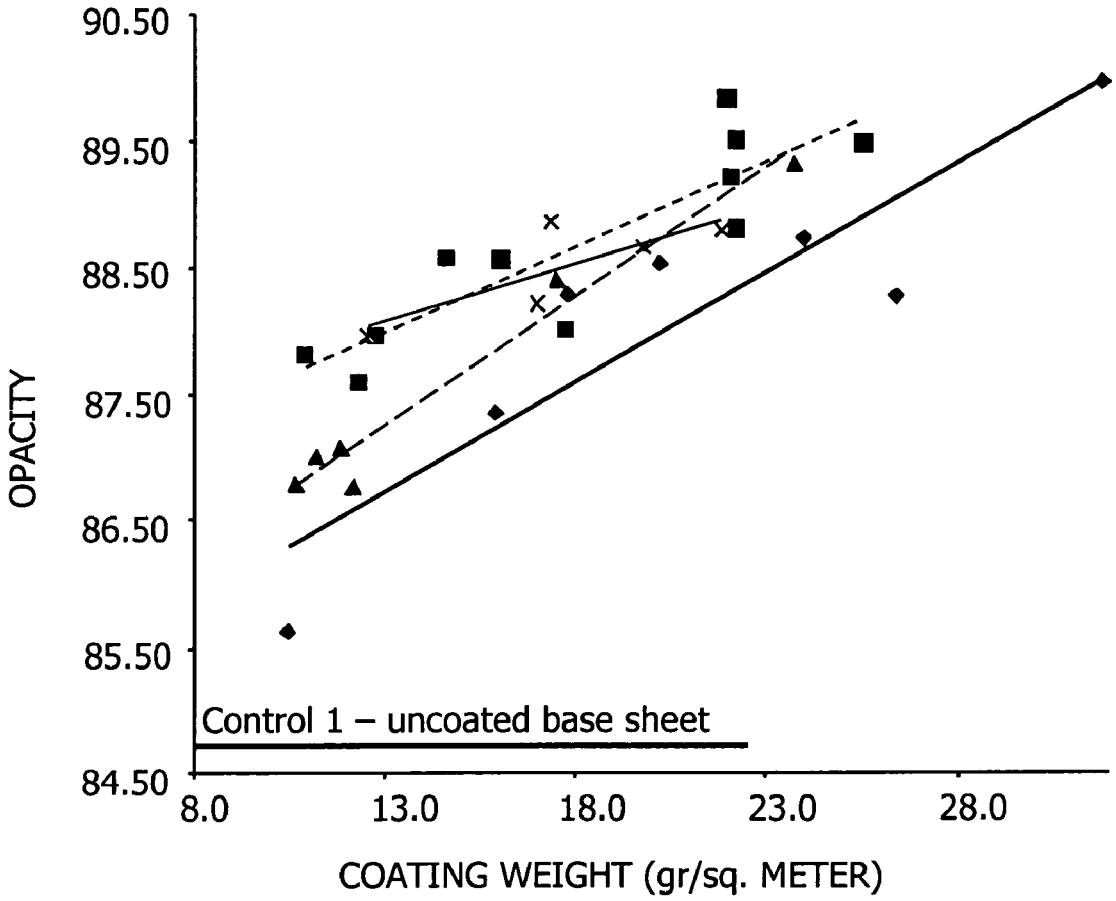
FIG. 1 shows the effect on opacity of various aqueous pigmented coating formulations applied to paper in various coating weights.

The present invention is generally directed to an aqueous pigmented coating formulation for improving the opacity of paper, paperboard, and other related products coated with the coating formulation. Specifically, the present invention relates to an aqueous pigmented coating formulation including an acylated lecithin, which comprises less than 10% (by total weight acylated lecithin) free fatty acid and is substantially free of fatty acid esters and surfactants. It has been found that when the acylated lecithin is added to the aqueous pigmented coating formulations described herein, paper and/or paperboard coated with the coating formulation has increased opacity. This increase in opacity is obtained without the use of expensive additives, and thus, results in a lower cost to the coating formulation manufacturers and the coated paper and paperboard producers.

Aqueous pigmented coating formulations are typically prepared by dispersing a coating pigment in a first aqueous solution, dispersing an adhesive or binder in a second aqueous solution, and then mixing the two aqueous solutions together to provide the final formulation. Additionally, additives, such as the acylated lecithin described herein, can also be added into a third aqueous solution, to one of the first or second aqueous solutions, or to the combined first and second aqueous solution to provide the final formulation. As noted above, the additives can improve the physical and optical properties of the coated paper and/or paperboard.

Generally, aqueous pigmented coating formulations comprise from about 30% (by weight formulation) to about 72% (by weight formulation) total non-volatile solids, with the balance being water. Suitably, the aqueous pigmented coating formulations comprise from about 40% (by weight formulation) to about 72% (by weight formulation) total non-volatile solids, and more suitably, from about 50% (by weight formulation) to about 72% (by weight formulation) total non-volatile solids, with the balance being water.

The amount of total solids in the aqueous pigmented coating formulation can affect the physical properties of the final coated paper product. The application of pigmented coatings containing as high in weight percent solids as is practical improves smoothness, gloss, and print quality. Additionally, the theological properties of aqueous pigmented coatings are directly influenced by solids content, which in turn directly affects coating processes. For example, when the solids content of a coating formulation is increased, the viscosity of the coating formulation is increased. This can affect the speed of the coating machine, as well as energy requirements to dry coating/paper structures.

As noted above, in one embodiment the aqueous pigmented coating formulations described herein comprise a pigment, a binder, and an acylated lecithin. Coating pigments suitable for use in the aqueous pigmented coating formulations of the present invention are well known to those skilled in the art and disclosed, for example, in U.S. Pat. No. 6,030,443, issued to Bock, et al. (Feb. 29, 2000) and U.S. Pat. No. 5,766,331, issued to Krinski, et al. (Jun. 16, 1998), both of which are incorporated in their entirety by reference.

The pigment or pigments present in the aqueous pigmented coating formulation fills in irregularities in the paper surface. This results in an even and uniformly absorbent surface for printing and improves the overall appearance of the coated sheet. The choice of pigments to be used in the aqueous pigmented coating formulations described herein is based on the resulting properties desired in the paper product surface and can be chosen by one skilled in the art. Suitable exemplary pigments for use in the aqueous pigmented coating formulation of the present invention include calcium carbonate (synthetic, precipitated material, or ground from naturally occurring mineral), calcined kaolin, hydrous kaolin, China clay, talc, mica, dolomite, silica, silicates, zeolite, gypsum, satin white, titania, titanium dioxide, calcium sulfate, barium sulfate, aluminum trihydrate, lithopone, blanc fixe, plastic pigment, and combinations thereof.

Typically, the pigment is present in the aqueous pigmented coating formulation in an amount of from about 65% (by total weight solids) to about 97% (by total weight solids). More suitably, the pigment is present in the aqueous pigmented coating formulation in an amount of from about 78% (by total weight solids) to about 95.5% (by total weight solids). Generally, the amount of pigment present in the aqueous pigmented coating formulations described herein is not critical and may vary greatly depending upon the desired properties in the final paper product. One skilled in the art can easily determine a suitable amount of pigment for a desired application based on the disclosure herein.

Additionally, the aqueous pigmented coating formulations of the present invention comprise a binder, sometimes referred to as an adhesive. As described herein above, the binder influences the properties of the paper product both during the coating process and after the coating process, when printing processes are run. Specifically, during the coating process, the binder provides cohesion of all coating components in the dried coating and adhesion of the coating to the paper web. Further, the binder, along with water, serves as a carrier for the pigment and influences the rheologic behavior and water retention of the coating formulation during the coating procedure.

Suitable binder for use in the aqueous pigmented coating formulations of the present invention can include, for example, proteins, starches, gums, resins, emulsion polymers such as latexes, casein, polyvinyl alcohol, and combinations thereof. Suitable proteins for use as binder in the aqueous pigmented coating formulation include soy proteins. Suitable starches for use as binder in the aqueous pigmented coating formulation can include corn starch, tapioca, white potato, sorghum, waxy corn, waxy sorghum, sweet potato, rice, and wheat starch. Suitable latex emulsion polymers include styrene butadiene rubber, styrene acrylate, styrene acrylonitrile, vinyl acrylate, acrylic, polyvinyl acetate, and combinations thereof.

Generally, when producing aqueous pigmented coating formulations, the binder and any other additives present are included in the formulations as "parts per hundred parts of pigment"; that is, the amounts of binder and various other additives are referenced against the amount of pigment present. Typically, the aqueous pigmented coating formulations of the present invention include binder in an amount of from about 3.0 parts (per hundred parts pigment) to about 30 parts (per hundred parts pigment), more typically, from about 4.2 parts (per hundred parts pigment) to about 25.6 parts (per hundred parts pigment). As with the pigment described herein, the amount of binder present in the aqueous pigmented coating formulations described herein is not critical and may vary greatly depending upon the desired properties in the final paper product. One skilled in the art can easily determine a suitable amount of binder for a desired application based on the disclosure herein.

In addition to the pigment and binder, the aqueous pigmented coating formulations of the present invention further comprise an acylated lecithin. As used herein, the term "acylated lecithin" means a lecithin that has been chemically modified by acylation and includes less than 10% (by weight acylated lecithin) free fatty acid.

Lecithin, which comprises an acetone soluble and an acetone insoluble fraction, can be derived from a variety of plant and animal sources including, but not limited to, soybeans, rapeseed, sunflowers, corn, egg, and microbial sources. Lecithin consists of a naturally occurring mixture of phospholipids, glycolipids, neutral lipids, and sugars. Specifically, the major phospholipids are phosphatidylcholine, phosphatidylethanolamine, phosphatidylinositol, and phosphatidic acid. Typically, the glycolipids include esterified steryl glucosides, steryl glucosides, and digalactosyl diglycerides. The neutral lipids can include triglycerides and fatty acids. The sugars are primarily sucrose, raffinose, and stachyose. The amounts and ratios of the various components will vary with the source of the lecithin.

One process suitable for preparing lecithin for acylation includes cracking soybeans to remove the hull, rolling them into flakes with flaking machines, and defatting the flakes with a suitable solvent such as hexane. Suitable flaking machines consist of a pair of horizontal counter-rotating smooth steel rolls. The rolls are pressed one against the other by means of heavy springs or by controlled hydraulic systems. The soybeans are fed between the rolls and are flattened as the rolls rotate one against the other. The roll-to-roll pressure can be regulated to determine the average thickness of the flakes. The rolling process disrupts the oil cell, facilitating solvent extraction (i.e., hexane) of the oil. Specifically, flaking increases the contact surface between the oilseed tissues and the solvent. Once the flakes are defatted, thereby removing the soybean oil, lecithin gums are separated from the oil by the addition of water and centrifugation or steam precipitation. Typically, at this point, the lecithin gums contain about 25% (by weight) moisture, 50% (by weight) phospholipids, and 25% (by weight) soy oil.

As noted above, the aqueous pigmented coating formulation of the present invention comprises a lecithin that has been chemically modified, specifically, an acylated lecithin. Processes suitable for modifying the lecithin to produce an acylated lecithin as discussed herein are well known in the art and are disclosed, for example, in U.S. Pat. No. 4,479,977, issued to Dashiell, et al. (Oct. 30, 1984) and U.S. Pat. No. 3,301,881, issued to Davis (Jan. 31, 1967), both of which are herein incorporated in their entirety by reference.

One exemplary process includes modifying the lecithin gum produced in the above described process by adding 0.5% (by weight lecithin gums) to about 5.0% (by weight lecithin gums) organic acid anhydride, more suitably adding from about 0.5% (by weight lecithin gums) to about 3.5% (by weight lecithin gums) organic acid anhydride, and even more suitably, adding 2.0% (by weight lecithin gums) organic acid anhydride. The amount of organic anhydride needed generally depends on the level of phosphatides in the gums. Suitable acid anhydrides for use in modifying the lecithins of the present invention include, but are not limited to, acetic anhydride, succinic anhydride, maleic anhydride, diacetyltartaric anhydride, phthalic anhydride, and combinations thereof. A preferred organic anhydride is acetic anhydride, which can be used to produce an acetylated lecithin for use in the aqueous pigmented coating formulations of the present invention.

Directly following treatment with an organic anhydride, the acylated lecithin is treated with an aqueous solution or suspension of a base, or a basic salt, to give the lecithin a pH of greater than about 6.5. Typically, the acylated lecithin is treated with a basic compound in an amount of from about 5.0% (by weight lecithin gums) to about 20% (by weight lecithin gums), suitably about 12% (by weight lecithin gums). Suitable basic compounds for raising the pH of the lecithin include, but are not limited to, sodium hydroxide, sodium bicarbonate, ammonia, calcium hydroxide, and combinations thereof. Finally, the acylated lecithin is vacuum-dried to produce an acylated lecithin suitable for use in the present invention.

Additionally, the lecithin gums may be dissolved in edible oil carriers or other carriers after the acylation. These oil carriers can dilute lecithin gums to reach a desired amount of acetone insoluble material in the lecithin gums. Suitable oil carriers can include any vegetable oil or mineral oil known in the art. A preferred oil carrier is soybean oil.

In addition to the treatment with oil carriers, the lecithin gums may be bleached before, during, or after acylation with oxidizing agents such as hydrogen peroxide and benzoyl peroxide. Typically, oxidizing agents can be added to the lecithin gums in an amount of from about 0.5% (by weight lecithin gums) to about 2.0% (by weight lecithin gums), more suitably, the oxidizing agents can be added to the lecithin gums in an amount of about 1.0% (by weight lecithin gums).

As noted above, the lecithins for acylation typically comprise an acetone soluble fraction and an acetone insoluble fraction. Suitably, the lecithin for acylation comprises an acetone insoluble fraction of greater than 50% (by weight lecithin gums), more suitably the lecithin for acylation comprises an acetone insoluble fraction of from about 60% (by weight lecithin gums) to about 70% (by weight lecithin gums), and even more suitably, about 66% (by weight lecithin gums) acetone insoluble fraction.

As discussed above, the acylated lecithin includes less than 10% (by weight acylated lecithin) free fatty acid. Typically, the free fatty acids are introduced into the acylated lecithin after acylation, suitably at the same time as the oils or oil carriers. Free fatty acids help to stabilize the viscosity of the acylated lecithin, which keeps the acylated lecithin from gelling or setting up. As defined herein above, the acylated lecithin comprises less than 10% (by total weight acylated lecithin) free fatty acid. Suitably, the acylated lecithin of the present invention comprises less than about 9% (by total weight acylated lecithin) free fatty acid, more suitably, the acylated lecithin of the present invention comprises less than about 8% (by total weight acylated lecithin) free fatty acid, even more suitably, the acylated lecithin of the present invention comprises less than about 7% (by total weight acylated lecithin) free fatty acid, and even more suitably, less than about 6% (by total weight acylated lecithin) free fatty acid. Suitable free fatty acids for use in the acylated lecithin described herein include, for example, linoleic acid, linolenic acid, oleic acid, palmitic acid, stearic acid, and combinations thereof.

Typically, the aqueous pigmented coating formulations of the present invention comprise from about 0.1 parts (per hundred parts pigment) to about 5.0 parts (per hundred parts pigment) acylated lecithin. More suitably, the aqueous pigmented coating formulations of the present invention comprise from about 0.3 parts (per hundred parts pigment) to about 1.5 parts (per hundred parts pigment) acylated lecithin, and even more suitably, the aqueous pigmented coating formulations of the present invention comprise from about 0.5 parts (per hundred parts pigment) to about 1.25 parts (per hundred parts pigment) acylated lecithin.

As noted above, the acylated lecithin of the present invention is substantially free of fatty acid esters and surfactants. In one embodiment, the acylated lecithin comprises less than 20% (by total weight acylated lecithin) total fatty acid esters and surfactants. In another embodiment, the acylated lecithin comprises less than about 5% (by total weight acylated lecithin) total fatty acid esters and surfactants. In a third embodiment, the acylated lecithin is completely free (i.e., comprises about 0% (by total weight acylated lecithin)) of total fatty acid esters and surfactants.

Without being bound to a particular theory, it is believed that the aqueous pigmented coating formulation comprising the acylated lecithin described herein above improves opacity of paper and/or paperboard coated with the formulation by increasing the number of air-pigment interfaces. Specifically, through steric hindrance, the acylated lecithin prevents the air-pigment interfaces from collapsing upon the drying of the aqueous pigmented coating formulation. The increase in the number of interfaces increases the efficacy and light scattering coefficient of the pigment. And, as noted above, increasing the light scattering coefficient provides for an improved opacity.

In addition to the pigment, binder, and acylated lecithin, the aqueous pigmented coating formulation of the present invention can include one or more conventional additives to improve the performance of the formulation. Suitably additives, for example, can be selected from the group consisting of eveners, lubricants, defoamers, wetting agents, optical brighteners, biocides, pigment-dispersing agents, cross-linkers, water retention aids, viscosity modifiers or thickeners, and combinations thereof.

In addition to aqueous pigmented coating formulations, the present invention is further directed to processes of making aqueous pigmented coating formulations for improving the opacity of paper and/or paperboard. In one suitable embodiment, the process comprises: (1) providing pigment; (2) providing from about 3.0 parts (per hundred parts pigment) to about 30 parts (per hundred parts pigment) binder; (3) providing from about 0.1 parts (per hundred parts pigment) to about 5.0 parts (per hundred parts pigment) acylated lecithin, wherein the acylated lecithin is substantially free of fatty acid esters and surfactants; and (4) mixing the pigment, binder, and acylated lecithin to form the aqueous pigmented coating formulation.

As noted above, the processes for producing the aqueous pigmented coating formulations for improving opacity comprise providing a pigment. The pigments suitable for use in the present invention can typically include minerals, such as calcium carbonate, calcined kaolin, hydrous kaolin, China clay, talc, mica, dolomite, silica, silicates, zeolite, gypsum, satin white, titania, titanium dioxide, calcium sulfate, barium sulfate, aluminum trihydrate, lithopone, blanc fixe, plastic pigment, and combinations thereof.

In addition to providing a pigment, the processes for producing the aqueous pigmented coating formulation of the present invention comprise providing a binder. Typically, the binder for use in the processes of the present invention can suitably be selected from proteins, starches, gums, resins, emulsion polymers such as latexes, casein, polyvinyl alcohol, and combinations thereof. Suitable proteins for use in the present invention include soy protein. Suitable starches include corn starch, tapioca, white potato, sorghum, waxy corn, waxy sorghum, sweet potato, rice, and wheat starch. Suitable latex emulsion polymers include styrene butadiene rubber, styrene acrylate, styrene acrylonitrile, vinyl acrylate, acrylic, polyvinyl acetate, and combinations thereof.

Generally, when processing aqueous pigmented coating formulations, binder is provided in the formulation in an amount of from about 3.0 parts (per hundred parts pigment) to about 30 parts (per hundred parts pigment). More typically, the binder is provided in an amount of from about 4.2 parts (per hundred parts pigment) to about 25.6 parts (per hundred parts pigment).

In addition to providing the pigment and binder, the processes for producing the aqueous pigmented coating formulation of the present invention comprise providing an acylated lecithin. As defined herein above, as used herein, the term "acylated lecithin" comprises a lecithin that has been chemically modified by acylation and includes less than 10% (by total weight acylated lecithin) free fatty acids. The lecithin for use in the acylated lecithin is prepared and acylated using the processes as discussed herein above.

As defined above, the acylated lecithins comprise less than 10% (by total weight acylated lecithin) free fatty acid. Suitably, the acylated lecithins comprise less than about 9% (by total weight acylated lecithin) free fatty acid, more suitably, the acylated lecithins of the present invention comprise less than about 8% (by total weight acylated lecithin) free fatty acid, even more suitably, the acylated lecithins of the present invention comprise less than about 7% (by total weight acylated lecithin) free fatty acid, and even more suitably, less than about 6% (by total weight acylated lecithin) free fatty acid. Suitable free fatty acids for use in the acylated lecithins described herein include, for example, linoleic acid, linolenic acid, oleic acid, palmitic acid, stearic acid, and combinations thereof.

In addition to the acylated lecithins including less than 10% (by total weight acylated lecithin) free fatty acid, the acylated lecithins for use in the processes of the present invention are substantially free of fatty acid esters and surfactants. In one embodiment, the acylated lecithin comprises less than 20% (by total weight acylated lecithin) total fatty acid esters and surfactants. In another embodiment, the acylated lecithin comprises less than about 5% (by total weight acylated lecithin) total fatty acid esters and surfactants. In a third embodiment, the acylated lecithin is completely free (i.e., comprises about 0% (by total weight acylated lecithin)) of total fatty acid esters and surfactants.

Typically, the processes of the present invention comprise providing the acylated lecithin in an amount of from about 0.1 parts (per hundred parts pigment) to about 5.0 parts (per hundred parts pigment). More typically, the processes of the present invention comprise providing the acylated lecithin in an amount of from about 0.3 parts (per hundred parts pigment) to about 1.5 parts (per hundred parts pigment), and even more typically, from about 0.5 parts (per hundred parts pigment) to about 1.25 parts (per hundred parts pigment).

Once the pigment, binder, and acylated lecithin are provided, they are mixed together to form the aqueous pigmented coating formulation. Preparation of coating formulations are well known in the art and disclosed, for example, in U.S. Pat. No. 5,766,331 issued to Krinski, et al. (Jun. 16, 1998) and U.S. Pat. No. 4,421,564 issued to Graham, et al. (Dec. 20, 1983), both of which are incorporated by reference in their entirety. In one embodiment, the aqueous pigmented coating formulation is formed by dispersing the binder ingredients, the pigment, and the acylated lecithin separately in three separate aqueous solutions comprising water. Once the binder, pigment, and acylated lecithin are sufficiently dispersed, the binder, pigment, and acylated lecithin are mixed together to provide a slurry having a solids content of at least about 30% by weight of the slurry, and more suitably from about 57% to about 67% by weight of the slurry.

Following dispersion of the mineral pigment, the binder, and the acylated lecithin in the aqueous solution, the pH of the slurry is controlled to a defined level of from about 7.0 to about 10.0, and more suitably from about 8.0 to about 9.0. The pH of the slurry prior to any adjustment will in great part be influenced by the pH of the slurry comprising the pigment, binder, and acylated lecithin. Adjustment of pH in the process of the present invention is most commonly accomplished through the addition of either sodium hydroxide or ammonium hydroxide (aqueous ammonia).

The process of the present invention may further comprise adding an additive selected from the group consisting of eveners, lubricants, defoamers, wetting agents, optical brighteners, biocides, pigment-dispersing agents, cross-linkers, water retention aids, viscosity modifiers or thickeners, and combinations thereof.

Once the aqueous pigmented coating formulation is produced, the aqueous pigmented coating formulation can be applied to a paper product providing improved opacity. As used herein, the term "paper product" means paper or paperboard having a basis weight of from about 30 g/m$^2$ to about 600 g/m$^2$. Typically, when the paper product is paper, the paper product will have a basis weight of from about 30 g/m$^2$ to about 200 g/m$^2$. When the paper product is paperboard, the paper product will typically have a basis weight of from about 200 g/m$^2$ to about 600 g/m$^2$. Generally, the aqueous pigmented coating formulation can be applied to one or more sides of the paper product by any means known in the art. For example, paper coating methods include, but are not limited to, roll applicator and metering with roll, rod, blade, bar, air knife; pond applicator and metering with roll, rod, blade, bar, or air knife; fountain applicator and metering roll with roll, rod, blade, bar, or air knife; pre-metered films or patterns, such as gate roll, three-roll, anilox, gravure, film press, curtain, spray; and foam application. In one suitable embodiment, the paper product is fed through a rolling nip in which one of the rolls has been previously coated with the aqueous pigmented coating formulation. The coating formulation is transferred to the paper product's surface. The excess coating formulation is removed from the surface of the paper product using a steel trailing blade which creates a level coating profile on the surface of the sheet of the desired final add-on coating weight.

Typically, the aqueous coating formulation is applied to the paper product in an amount of from about 8 g/m$^2$ to about 26 g/m$^2$. More suitably, the aqueous coating formulation is applied to the paper product in an amount of from about 8 g/m$^2$ to about 16 g/m$^2$.

A coated paper product produced utilizing the aqueous pigmented coating formulation of the present invention will have an improved opacity as compared to an uncoated paper product, and compared to a paper product treated with an aqueous pigmented coating formulation which does not include the acylated lecithin as described herein. Opacity of a paper product is that property of a paper product which minimizes show-through of light through the sheet or printing from the back side or the next sheet. The opacity of a surface coating on a paper product is particularly important where the base fiber is dark or non-uniform. In one suitable embodiment, the opacity of the paper product is measured using the TAPPI Standard Method T 425 om-96. Suitably, using the TAPPI Standard Method T 425 om-96 or a similar suitably method, the coated paper product produced in the present invention has an improved opacity of about 1 point (i.e., 1%) as compared to the same paper product without any coating, more suitably, the coated paper product has an improved opacity of about 2 points (2%) as compared to the same paper product without any coating, and even more suitably, an improved opacity of about 3 points (3%) or more as compared to the same paper product without any coating.

EXAMPLES

The following examples are simply intended to further illustrate and explain the present invention. The invention, therefore, should not be limited to any of the details in these examples.

Example 1

In this Example, two aqueous pigmented coating formulations are produced and subsequently applied to paper. The first aqueous pigmented coating formulation is free of an acylated lecithin. The second aqueous pigmented coating formulation comprises an acylated lecithin. The opacity of paper coated with the aqueous pigmented coating formulation comprising an acylated lecithin is then compared to a control basestock that has not been coated with an aqueous pigmented coating formulation (Control 1) and to a paper coated with an aqueous pigmented coating formulation free of an acylated lecithin (Control 2).

Control 1 and the two aqueous pigmented coating formulations for evaluation are set forth in Table 1:

TABLE 1

| | Amounts of Ingredients expressed as parts per hundred parts pigment | | | | |
|---|---|---|---|---|---|
| Sample | Pigment 80:20 Calcium carbonate: kaolin clay | Binder (Styrene-butadiene rubber) | Pro-Cote 4200 | Lecithin | OBA |
| Control 1 | N/A | N/A | N/A | N/A | N/A |
| Control 2 | 100 | 9.5 | 2.0 | N/A | 1.0 |
| Sample comprising acylated lecithin | 100 | 9.5 | 2.0 | 0.75 | 1.0 |

N/A = Not Applicable

To begin the preparation of both aqueous pigmented coating formulations for evaluation, pre-dispersed aqueous slurries of calcium carbonate, available as Hydrocarb 90 (Omya Company, Dusseldorf, Germany), and kaolin clay, available as Hydragloss 90 (Huber Engineered Materials, Macon, Ga.), are blended in a ratio of 80:20, respectively, using constant agitation with a metal four-bladed impeller mixer at a speed of 1500 revolutions per minute (rpm) to produce an aqueous pigmented solution.

As noted above, in one embodiment, the aqueous pigmented coating formulation comprises acylated lecithin. Specifically, one of the aqueous pigmented coating formulations for evaluation comprises an acetylated lecithin, commercially available as Centrophase HR from the The Solae Co. (St. Louis, Mo.). The acetylated lecithin is mixed into the aqueous pigmented solution with a metal four-bladed impeller mixer at a speed of 1500 rpm for 15 minutes. The acetylated lecithin is mixed into the aqueous pigmented solution prior to mixing the binder into the aqueous pigmented solution.

Another additive for improving the performance properties of the aqueous pigmented coating formulations is a carboxylated, hydrogen peroxide-modified soy polymer, available as Pro-Cote 4200 (The Solae Company, St. Louis, Mo.). This soy polymer is added to the aqueous pigmented solution as a co-binder, viscosity modifier, and water holding agent. Specifically, the soy polymer is mixed into the aqueous pigmented solution using constant agitation with a metal four-bladed impeller mixer at a speed of 1500 rpm for 15 minutes.

The preparation of both aqueous pigmented coating formulations further includes mixing a binder with the aqueous pigmented solution. The binder for the aqueous pigmented coating formulations is an emulsion in water (50% by weight solids) comprising styrene butadiene rubber (available as Styronal ND656 from BASF, Charlotte, N.C.). The emulsion is mixed into the aqueous pigmented solution with a metal four-bladed impeller mixer at a speed of 1500 rpm until the emulsion is completely dispersed.

Finally, an optical brightener agent (OBA), available in solution as Blankophor P (Bayer, Pittsburgh, Pa.), is added to the aqueous pigmented solution to improve optical properties of the paper coated with the aqueous pigmented coating formulations. The OBA is added to the solution by mixing the OBA into the aqueous pigmented solution with a metal four-bladed impeller mixer at a speed of 1500 rpm until the OBA is completely dispersed.

Once the aqueous pigmented coating formulations are made, about 12 $g/m^2 \pm 0.5$ $g/m^2$ of the aqueous pigmented formulations, are applied to one side of an 89 $g/m^2$ uncoated paper basestock. Specifically, one side of paper basestock is coated using a hand draw-down smooth rod method as known in the art using the aqueous pigmented coating formulations above. The opacity property of the paper sample coated with the aqueous pigmented coating formulation comprising acylated lecithin is then compared to an uncoated paper sample (Control 1) and to a paper sample coated with the aqueous pigmented coating formulation of Control 2.

The opacity properties of Control 1 and the paper samples coated with the aqueous pigmented coating formulations are determined using an opacity meter and the TAPPI Standard Method T 425 om-96. The testing environment should be controlled, having a relative humidity not exceeding 60% and a temperature of about 23.0±4.0° C. Five TAPPI opacity readings for each paper sample are run and the results are averaged. The opacity results of the paper sample coated with the aqueous pigmented coating formulation comprising acylated lecithin is then compared to the results of the uncoated Control 1 and the paper sample coated with the aqueous pigmented coating formulation of Control 2. The averaged results of the opacity measurements and the standard deviation of the five opacity measurements for each paper sample are shown in Table 2:

TABLE 2

| Sample | Opacity, TAPPI (points) |
|---|---|
| Control 1 | 92.4 |
| Control 2 | 94.8 |
| Sample comprising acetylated lecithin | 95.3 |

As well known in the art, when comparing TAPPI opacity readings, the higher the reading, the more improved the opacity property of the paper sample. As shown in Table 2, both paper samples coated with an aqueous pigmented coating formulation improve opacity as compared to the uncoated Control 1. The greatest increase in opacity compared to uncoated Control 1 can be seen with the paper sample coated with the aqueous pigmented coating formulation comprising acylated lecithin. Specifically, the paper sample coated with the aqueous pigmented coating formulation comprising acylated lecithin improved opacity by 2.9 units (i.e., 3.1%) compared to the uncoated Control 1. Additionally, the paper sample coated with the aqueous pigmented coating formulation comprising acylated lecithin has an improved opacity as compared to the paper sample coated with the aqueous pigmented coating formulation of Control 2. Specifically, the paper sample coated with the aqueous pigmented coating formulation comprising acylated lecithin improved opacity by 0.5 units compared to the paper sample coated with the aqueous pigmented coating formulation of Control 2.

Example 2

In this Example, aqueous pigmented coating formulations comprising acetylated lecithin are produced and subsequently applied to paper in various coating weights. The opacities of the paper samples coated with the aqueous pigmented coating formulations are then compared to basestock that has not been coated with an aqueous pigmented coating formulation (Control 1) and to a paper sample coated with an aqueous pigmented coating formulation free of acetylated lecithin (Control 2).

The aqueous pigmented coating formulations are made using the method of Example 1 with the exception of additionally using polyvinyl alcohol, commercially available in an aqueous solution as Celvol 203S (Celanese Noviant, The Netherlands) as a co-binder. Specifically, when polyvinyl alcohol is included in the aqueous pigmented coating formulation, the polyvinyl alcohol is mixed into the aqueous pigmented solution using constant agitation with a metal four-bladed impeller mixer at a speed of 1500 rpm for 15 minutes. Control 1 and the various aqueous pigmented coating formulations are shown in Table 3 below:

TABLE 3

| Sample | Amounts of Ingredients expressed as parts per hundred parts pigment | | | | | |
|---|---|---|---|---|---|---|
| | Pigment 80:20 Calcium carbonate: kaolin clay | Binder (Styrene-butadiene rubber) | Pro-Cote 4200 | Polyvinyl Alcohol | Acetylated Lecithin | OBA |
| Control 1 | N/A | N/A | N/A | N/A | N/A | N/A |
| Control 2 | 100 | 10.5 | 0 | 0 | 0 | 1.0 |
| Sample A | 100 | 10.5 | 0 | 0 | 0.75 | 1.0 |
| Sample B | 100 | 11.0 | 0 | 1.0 | 0.75 | 1.0 |
| Sample C | 100 | 9.5 | 2.0 | 0 | 0.75 | 1.0 |

N/A = Not Applicable

Once the aqueous pigmented coating formulations are made, the formulations, in various coating weights are applied to one side of a 68 g/m$^2$ uncoated paper basestock. Specifically, one side of paper basestock is coated using a hand draw-down smooth rod method as known in the art using the aqueous pigmented coating formulations above. The various coating weights of the formulations are shown in Table 4:

TABLE 4

| Sample | Coating Weight (g/m$_2$) | | | | | | | | | | |
|---|---|---|---|---|---|---|---|---|---|---|---|
| Control 1 | N/A | N/A | N/A | N/A | N/A | N/A | N/A | N/A | N/A | N/A | N/A |
| Control 2 | 10.48 | 15.88 | 26.42 | 20.24 | 17.77 | 31.80 | 23.97 | | | | |
| Sample A | 17.74 | 22.20 | 25.58 | 22.08 | 21.98 | 22.21 | 14.59 | 16.00 | 12.70 | 12.27 | 10.93 |
| Sample B | 12.14 | 11.84 | 10.65 | 11.20 | 17.48 | 23.75 | | | | | |
| Sample C | 19.76 | 21.81 | 12.50 | 17.37 | 16.97 | | | | | | |

N/A = Not Applicable

The opacity properties of uncoated Control 1 and the paper coated with the aqueous pigmented coating formulations are determined using an opacity meter and the TAPPI Standard Method T 425 om-96 as in Example 1. FIG. 1 is subsequently produced using the results of the opacity evaluation for the various paper samples.

As shown in FIG. 1, which is produced at a 95% confidence level, the paper samples coated with the aqueous pigmented coating formulations improve opacity as compared to uncoated Control 1. Specifically, the paper samples coated with the aqueous pigmented coating formulations improve opacity compared to Control 1 at all of the various coating weights. Additionally, the paper samples coated with the aqueous pigmented coating formulations comprising acylated lecithin improve opacity at every coating weight when compared to the paper sample coated with the aqueous pigmented coating formulation of Control 2.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An aqueous pigmented coating formulation for improving opacity comprising pigment, from about 3.0 parts (per hundred parts pigment) to about 30 parts (per hundred parts pigment) binder, and from about 0.1 parts (per hundred parts pigment) to about 5.0 parts (per hundred parts pigment) acylated lecithin, wherein the comprises less than about 5% by total weight acylated lecithin.

2. The aqueous pigmented coating formulation as set forth in claim 1 wherein the formulation comprises from about 0.3 parts (per hundred parts pigment) to about 1.5 (per hundred parts pigment) acylated lecithin.

3. The aqueous pigmented coating formulation as set forth in claim 1 wherein the acylated lecithin comprises acetylated lecithin.

4. The aqueous pigmented coating formulation as set forth in claim 1 wherein the binder is selected from the group consisting of proteins, starches, gums, resins, emulsion polymers, casein, polyvinyl alcohol, and combinations thereof.

5. The aqueous pigmented coating formulation as set forth in claim 1 wherein the pigment is selected from the group consisting of calcium carbonate, calcined kaolin, hydrous kaolin, China clay, talc, mica, dolomite, silica, silicates, zeolite, gypsum, satin white, titania, titanium dioxide, calcium sulfate, barium sulfate, aluminum trihydrate, lithopone, blanc fixe, plastic pigment, and combinations thereof.

6. The aqueous pigmented coating formulation as set forth in claim 1 further comprising an additive selected from the group consisting eveners, lubricants, defoamers, wetting agents, optical brighteners, biocides, pigment-dispersing agents, cross-linkers, water retention aids, viscosity modifiers or thickeners, and combinations thereof.

7. A process for producing an aqueous pigmented coating formulation for improving opacity, the process comprising:

providing pigment;

providing from about 3.0 parts (per hundred parts pigment) to about 30 parts (per hundred parts pigment) binder;

providing from about 0.1 parts (per hundred parts pigment) to about 5.0 parts (per hundred parts pigment) acylated lecithin, wherein the acylated lecithin comprises less than about 5% by total weight acylated lecithin fatty acid esters and surfactants; and mixing the pigment, binder, and acylated lecithin to form the aqueous pigmented coating formulation.

8. The process as set forth in claim 7 wherein the acylated lecithin is provided in an amount of from about 0.3 parts (per hundred parts pigment) to about 1.5 parts (per hundred parts pigment).

9. The process as set forth in claim 7 wherein the acylated lecithin comprises acetylated lecithin.

10. The process as set forth in claim 7 wherein the binder is selected from the group consisting of proteins, starches, gums, resins, emulsion polymers, casein, polyvinyl alcohol, and combinations thereof.

11. The process as set forth in claim 7 wherein the pigment is selected from the group consisting of calcium carbonate, calcined kaolin, hydrous kaolin, China clay, talc, mica, dolomite, silica, silicates, zeolite, gypsum, satin white, titania, titanium dioxide, calcium sulfate, barium sulfate, aluminum trihydrate, lithopone, blanc fixe, plastic pigment, and combinations thereof.

12. The process as set forth in claim 7 further comprising an additive selected from the group consisting of eveners, lubricants, defoamers, wetting agents, optical brighteners, biocides, pigment-dispersing agents, cross-linkers, water retention aids, viscosity modifiers or thickeners, and combinations thereof.

13. The process as set forth in claim 7 further comprising applying the aqueous pigmented coating formulation to paper in an amount of from about 8 $g/m^2$ to about 26 $g/m^2$.

14. A coated paper product produced utilizing an aqueous pigmented coating formulation comprising an acylated lecithin, wherein the coated paper product is produced utilizing from about 8 $g/m^2$ to about 26 $g/m^2$ of the aqueous pigmented coating formulation, wherein the coated paper product has an improved opacity of about 1% as compared to the same paper product without any coating and wherein the acylated lecithin comprises less than about 5% by total weight acylated lecithin fatty acid esters and surfactants.

15. The coated paper product as set forth in claim 14 wherein the aqueous pigmented coating formulation comprises pigment, from about 3.0 parts (per hundred parts pigment) to about 30 parts (per hundred parts pigment) binder, and from about 0.1 parts (per hundred parts pigment) to about 5.0 parts (per hundred parts pigment) acylated lecithin.

16. The coated paper product as set forth in claim 15 wherein the aqueous pigmented coating formulation comprises from about 0.3 parts (per hundred parts pigment) to about 1.5 parts (per hundred parts pigment) acylated lecithin.

17. The coated paper product as set forth in claim 15 wherein the acylated lecithin comprises acetylated lecithin.

* * * * *